US005239301A

United States Patent [19]

Martin

[11] Patent Number: 5,239,301

[45] Date of Patent: Aug. 24, 1993

[54] PHASE/PHASE/FREQUENCY-SCAN RADAR APPARATUS

[75] Inventor: Raymond G. Martin, Ellicott City, Md.

[73] Assignee: The United States of America as represented by the Secretary of the Air Force, Washington, D.C.

[21] Appl. No.: 358,294

[22] Filed: May 26, 1989

[51] Int. Cl.[5] ..... H01Q 3/22

[52] U.S. Cl. ..... 342/375; 342/368

[58] Field of Search ..... 342/368, 372, 375

[56] References Cited

U.S. PATENT DOCUMENTS 3,646,559 2/1972 Wiley ..... 343/100 SA
3,860,928 1/1975 Ehrlich ..... 343/100 SA
3,979,754 9/1976 Archer .
4,028,710 6/1977 Evans .
4,178,581 12/1979 Willey, Sr. .
4,612,547 9/1986 Itoh .
4,724,438 2/1988 Arnold et al. ..... 342/157
4,779,097 10/1988 Morchin ..... 342/368

*Primary Examiner*—Theodore M. Blum
*Attorney, Agent, or Firm*—William Stepanishen; Donald J. Singer

[57] ABSTRACT

A phase/phase/frequency-scan radar apparatus having multiple-beam search and single-beam track capabilities, using a single array antenna employing a novel combination of phase/phase scan in two dimensions together with frequency-scan. Generally, the additional frequency scan capability need be used in one dimension only, preferably azimuth, but the concept could readily be extended to two-dimensional add-on frequency scan if desired.

7 Claims, 3 Drawing Sheets

SEARCH DETECTION
NEAR BORESIGHT (0°)

1 ST. TRACK LOOK
(60° ROTATION)

2 ND. TRACK LOOK
(300° ROTATION)

3 RD. TRACK LOOK
(360° ROTATION)

4 TH. TRACK LOOK
(420° ROTATION)

PHASE/PHASE/FREQUENCY-SCAN RADAR APPARATUS

BACKGROUND OF THE INVENTION

The present invention relates broadly to a radar apparatus, and in particular to a phase/phase/frequency-scan radar apparatus.

In the prior art, the need for high speed surveillance radar is well recognized. The present day and future functional requirements for military surveillance radars are dominated by the need to provide target search and track functions over large coverage volumes in environments that include many high speed and maneuvering targets, with an associated need for track information to be generated on newly detected targets in the shortest possible track generation time. Radar units which employ antennas with two-dimensional agile beam capabilities are best suited for these purposes, and stationary phase/phase scanned antennas have been used to provide such capabilities in some well known present day systems, such as Patriot and Aegis. However, phase/-phase scanned antennas are very costly, often prohibitively so, when it is required to provide 360° coverage in azimuth. Also, in order to achieve this 360° of coverage in azimuth, it is necessary to employ a minimum of three, and typically four, antenna arrays.

The state of the art of surveillance radar is well represented and alleviated to some degree by the prior art apparatus and approaches which are contained in the following U.S. Patents:

- U.S. Pat. No. 3,646,559 issued to Wiley on Feb. 29, 1972;
- U.S. Pat. No. 3,860,928 issued to Ehrlich on Jan. 14, 1975;
- U.S. Pat. No. 4,724,438 issued to Arnold et al on Feb. 9, 1988; and
- U.S. Pat. No. 4,779,097 issued to Morchin on Oct. 18, 1988.

The Wiley patent describes a multimode antenna for simultaneously providing at least one frequency-scanning mode and a phase-scanned mode. The isolated ports of the directionally coupled radiating apertures of a cross-fed frequency-scanned array, are adapted to be fed from a fixed frequency source by a phased array of voltage-controlled phase shifters or by mechanically scanned means for adjusting the phase gradient (or by a combination of the two). The fixed frequency corresponds to a direction-frequency (of the frequency-scanned array) outside the range of direction to be covered by the phased array, thereby providing mutual isolation between the phased-array energy and the frequency-scanning energy.

The Ehrlich patent is directed to a system of radiating elements arranged for forming one or more beams of radiation having radiation patterns such as a monopole, dipole, quadrupole, other multipoles or combination thereof. The individual radiating elements of the array are interconnected by circuitry providing for the summing and differencing of signals provided by adjacent radiating elements in response to incident radiation.

The Arnold et al patent relates to a radar system of the type which can be presented with a number of tasks to be performed. Some of these tasks, e.g. the surveillance of areas at close range, may only require the transmission of low energy pulses and thus the full potential of the r.f. energy source has not previously been used while such tasks are being handled.

The Morchin patent discusses a segmented phased array antenna system for scanning two different ranges of directions with a single set of antenna elements which are movable between first and second positions. In each set of positions, the antenna elements are operated as a conventional phased array radar system.

A more cost-effective approach that is currently being considered for future systems, such as the Advanced Tactical Surveillance Radar for the USAF, is to employ a single rotating agile beam array, but with provision for operation in a stationary, trainable mode when the threats are predominantly in a limited azimuth sector. This type of operation, particularly in the rotational mode, imposes severe time/energy management demands on the radar, and generally requires the provision of multiple simultaneous beams to accomplish the search function. On the other hand, the track function requires individual steerable pencil beams.

While the above-cited references are instructive, a need remains to provide a surveillance radar to accommodate threats in a limited azimuth sector. The present invention is intended to satisfy that need.

SUMMARY OF THE INVENTION

The present invention utilizes a search radar apparatus that uses an antenna with phase/phase scan capabilities in the azimuth and elevation planes together with frequency scan in one or both of these planes, but preferably in azimuth only, so that by proper wave form choice multiple simultaneous azimuth beams can be formed when needed, for example in search, but also permitting the formation of a single beam, steerable over wide angles, for track, without the need for high power transmit switches. The technique is applicable for use in either a stationary or rotational antenna. In the rotational mode, the multiple beam capability provides a solution to the time/energy management problem typically experienced by a single beam antenna, and the single beam capability combined with wide angle phase steering enables rapid track initiation to be accomplished. A new, adaptive time-sequential frequency diversity approach is used in either the stationary or rotational modes of operation to minimize the time and energy needed to update tracks, and to enhance angular accuracy on fluctuating targets.

It is one object of the present invention, therefore, to provide an improved phase/phase frequency-scan radar apparatus.

It is another object of the invention to provide an improved phase/phase frequency-scan radar apparatus utilizing an antenna with phase/phase scan capabilities in the azimuth and elevation planes, together with frequency scan capabilities in one or both of these planes, but preferably in azimuth only, so that by proper waveform choice, multiple simultaneous azimuth beams can be transmitted and received when desired.

It is still another object of the invention to provide a improved phase/phase frequency-scan radar apparatus wherein multiple simultaneous beams are produced for search purposes, but a single beam, steerable over wide angles is produced for track without the need for high power transmit switches.

It is yet another object of the invention to provide a improved phase/phase frequency-scan radar apparatus utilizing an adaptive, time-sequential frequency diversity to minimize the time and energy needed to update tracks, and to enhance annular track accuracy on fluctuating targets.

It is still another object of the invention to provide a improved phase/phase frequency-scan radar apparatus utilizing an antenna as described in a mechanically rotating mode, to accomplish the search function using antenna beams at or near the array boresight (broadside), but to use track beams steered over wide angles relative to boresight to accomplish the track initiation function for newly detected targets in a minimum of time.

It is still another object of the invention to provide an improved phase/phased frequency-scan radar apparatus which is economical to produce and utilizes conventional, currently available components that lend themselves to standard mass production manufacturing techniques.

These and other advantages, objects and features of the invention will become more apparent after considering the following description taken in conjunction with the illustrative embodiment in the accompanying drawings.

DESCRIPTION OF THE PREFERRED EMBODIMENT

Figure 1:
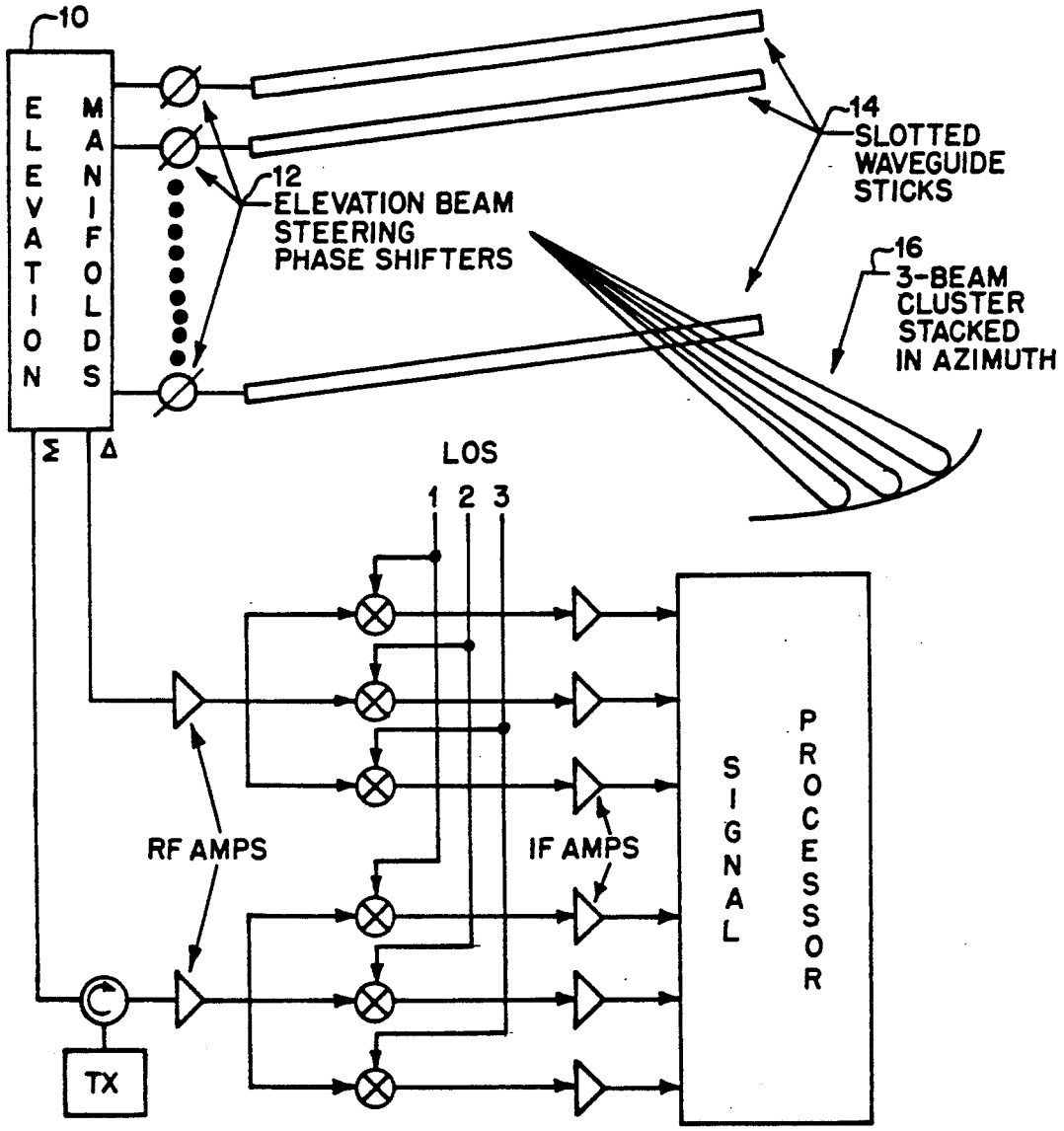
FIG. 1 is a block diagram of a radar utilizing the combination of one dimensional phase scan in elevation in one directional frequency scan in azimuth which is operated in a strictly rotational mode.

Referring now to FIG. 1, there is shown a block diagram of a 3-D surveillance radar apparatus. The antenna array comprises elevation manifolds 10 which are operatively connected by a plurality of elevation beam steering phase shifters 12 to a plurality of slotted waveguide sticks 14. A three-beam cluster 16 which is stacked in azimuth, is shown for illustrative purposes. The antenna array provides a combination of one dimensional phase scan in elevation and one dimensional frequency scan in azimuth, that operate in a strictly rotational mode, and provided track-while-scan (TWS) capabilities only. The principal merit of the 3-D surveillance radar apparatus is that it uses the azimuth frequency scan capability to create a number of simultaneous beams in azimuth by transmitting pulses which comprise a corresponding number of contiguous subpulses, appropriately spaced in frequency, to form a fan of transmit beams in azimuth. As indicated in FIG. 1 the particular case of three beams in the fan is presented as an example of an azimuth beam fan. As further shown in the FIG. 1, the receiver comprises a suitable number of tuned RF channels to form a corresponding azimuth-fan of receive beams.

The present invention is an improvement over the previous concept by providing a further phase scan capability in the azimuth dimension, with the objective of enhancing the radar's track generation and track data rate capabilities. This is accomplished while maintaining the cost-effective, frequency-scan capability for creating multiple simultaneous azimuth beams in the search mode by waveform selection as described above. The method of providing the enhanced track capability in the new concept differs depending on whether the radar is operating in the rotating or stationary mode, which will be described in detail in the following paragraphs. However, to provide a clearer picture of how those capabilities are achieved, a description will first be given of one way in which the new concept may be incorporated in the antenna array.

Figure 2:
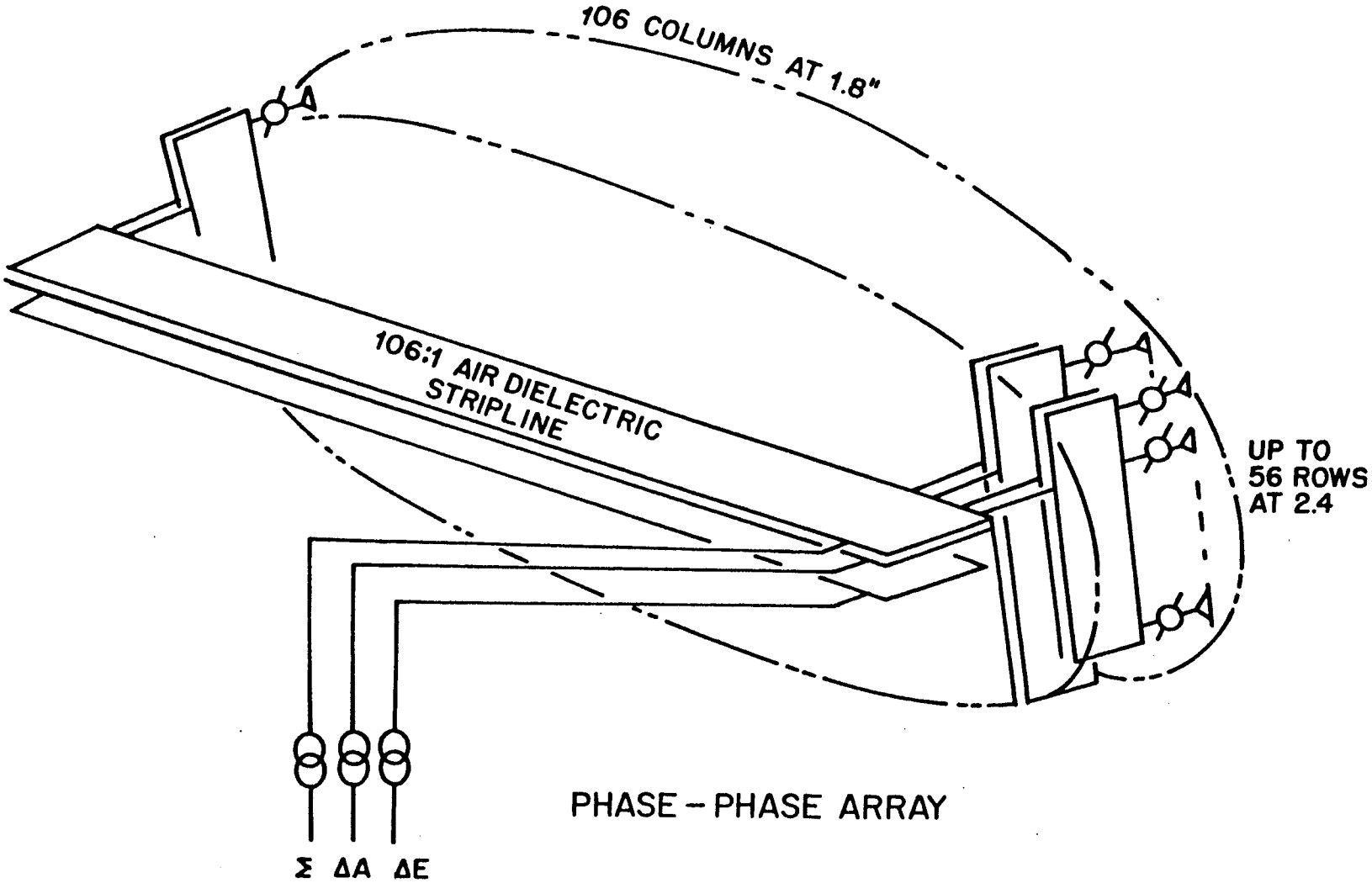
FIG. 2 is a schematic illustration of a phase/phase scanned antenna with end-feed azimuth manifolds.
Figure 3A:
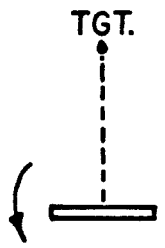
FIGS. 3*a*–3*e* are a graphical illustration of rapid track initiation using a rotating phase scanned array.
Figure 3B:
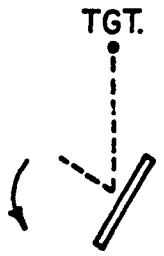
Figure 3C:
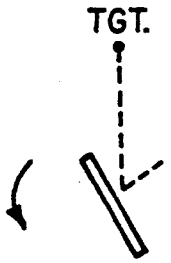
Figure 3D:
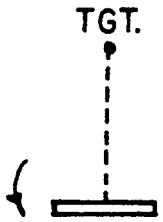
Figure 3E:
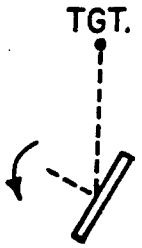

Turning now to FIG. 2, there is shown an example of an antenna array which incorporates and implements the combined phase/frequency scan capability for an array that has phase shifters at each of the radiating elements. With this arrangement, the phase shifters provide the phase/phase scan capability in the conventional way. In order to provide the additional frequency scan capability in this particular configuration, the element outputs are first combined in vertical elevation manifolds that provide elevation sum and difference pattern outputs, and these outputs are then further combined in end-fed (dispersive) azimuth manifolds to give sum elevation difference, and azimuth difference pattern outputs. There are other mainfolding combinations to achieve equivalent capability which are also possible. In general, for the arrangement shown in FIG. 2, the azimuth frequency scan sector width might typically be 20° for a simple end-fed azimuth manifold approach using typical radar operating bandwidths. However, if the situation or application required a greater azimuth sector width, it could be extended by the use of serpentine azimuth feeds. In such a case, the azimuth phase scan capability would typically be much greater, for example ±60° from the antenna array boresight.

It may be noted that the combination of phase and frequency scan in azimuth completely eliminates any fixed relationship between frequency choice and azimuth pointing angle, which results in corresponding ECCM advantages. Any given frequency choice can be used to create a beam at any desired angle within the phase scan coverage by appropriate settings of the phase shifters. However, it should be recognized that the use of phase scanning for large angles away from the antenna boresight, will cause loss of antenna gain, that is due to the smaller projected aperture area in the beam direction. Therefore, it is desirable for the search function, in the rotational mode, to employ the phase shifters so as to maintain the frequency scan coverage capability near the boresight direction in order to minimize such scan losses.

In the rotational mode, the search function can be performed at the antenna rotation rate, or perhaps at a submultiple of the rotation rate, or even at a mix of the two depending on elevation angle. However, for targets in track, the data would typically be updated at the maximum achievable rate, namely the rotation rate, regardless of the search rate in their vicinity. This would be done by using additional track dwells to provide track updates on any target scans in which the beam position containing the target are not visited by search dwells.

It may be noted that in these additional track dwells, the use of frequency scanning to create multiple simultaneous beams would not generally be used, except perhaps at very short range where high speed target motion might create uncertainty as to exactly which beam position might contain the target.

A track dwell would, therefore, typically comprise single frequency pulse transmissions, or possible single frequency pulse bursts when doppler processing is required. When pulse-to-pulse or burst-to-burst frequency diversity is needed to enhance detectability or improve anular accuracy against fluctuating (e.g. Sw.I) targets it would be done in a time sequential fashion and the phase shifter setting changes would be used, if necessary to counter any unwanted frequency-scan effects of the beam that result from the frequency changes, or perhaps to counter the rotational motion of the antenna.

The present invention precludes the use of wide range intra-pulse frequency diversity, as is sometimes employed to improve detectability and accuracy on fluctuating targets, because of the antenna squint characteristics, but the equivalent benefits are obtainable actually more efficiently by the time-sequential diversity approach described above. This is so for the reason given in the following paragraphs.

It may well be known prior to the track dwell that a particular frequency may be favorable for a good response from the target being tracked, for example from information obtained on a prior track dwell. In this case that particular frequency would be a logical one to try on the first pulse, or burst which is directed to the target at the start of the new track dwell. If no preferred frequency is known, an arbitrary choice of frequency can be made. In either case, after the target return echoes from the first pulse or burst have been received and processed, one of two possible situations will obtain, namely: either a return echo of adequate signal strength for detection or angular accuracy purposes will have been received from the vicinity of the tracked target range, in which case the dwell can be terminated, or alternatively the return echo signal strength will be inadequate. In the latter situation it is, of course, appropriate to change frequency sufficiently to make a target amplitude fluctuation likely, and to repeat the process as many times as necessary.

Such an adaptive track update process will generally be more efficient than full, non-adaptive diversity, because on the average the required total track dwell times will be shorter, and because with the time-sequential diversity approach, the full range of diversity that would need to be provided for a non-adaptive approach will not be necessary in every case to achieve adequate track update performance.

In order to make the most effective use of the adaptive track update process just described, it would best be implemented in such a way that the transmit energy used for any particular track pulse or burst is not excessive for the known characteristics of the tracked target, such as range, return amplitude from prior track dwells etc. The wasteful use of excessive energy on each particular tracked target can be avoided, while still obtaining the full benefit of the available average power of the transmitter, by the well known process or track "packing" or interleaving.

Since the range to the target is known with reasonable accuracy from the tracker data, it is not necessary to keep the receive beam or beams pointed in the target direction during the entire time between transmission of a pulse in the target direction and receipt of the return echo. The radar resources may therefore be used during this time interval to either transmit or receive pulses in the directions of other targets to be tracked within the scan coverage of the array. This assumes the phase shifter switching speeds are adequate for the purpose, as is usually the case.

By appropriately scheduling the interleaving of targets in this way, it will generally be possible, especially under high target density conditions, to come close to using the maximum average power capability of the radar transmitter while simultaneously minimizing the total time devoted to the dedicated track function.

The efficient accomplishment of the track function is important because the more time that is devoted to it, that much less time is available for search. Although this can be compensated for in time, if not in energy, by providing sufficiently long dwell times in the individual search beam positions and increasing the number of simultaneous search beams employed, there is a cost penalty. Each simultaneous search beam employed requires its full complement of sum, difference and perhaps sidelobe blanking receiver and signal processor channels, and in order to minimize cost, it is obviously important to minimize the number of channels required.

The above discussion was addressed specifically to track dwells as they would be employed for track maintenance. Track initiation would employ the same concepts but with additional features aimed at minimizing track initiation time.

As an illustration of how track initiation features would be provided, the following discussion assumes convenient and probably representative numbers for a rotation rate of 6 seconds, and an azimuth phase scan capability of ±60°. Assuming the search function is accomplished using beams approximately at the boresight of the antenna, as discussed above, or perhaps preferably steered somewhat ahead of boresight in the direction of rotation, when a new detection is made on a target not previously in track, that target will still remain within the antenna's phase scan coverage for at least the time the antenna takes to rotate 60°, namely 1 second. As the newly detected target approaches the limit of this azimuth coverage it is, therefore, reasonable from a time viewpoint to take a track look at the target as the first step in the track initiation process. The approximately one second interval between this look and the initial search detection will typically permit a first crude estimate of the target's velocity vector, that will benefit the subsequent stages of the initiation process with respect to target association window sizes and the ability to initiate tracks in a dense target environment.

Following the first track look, however, the new target will be out of the antenna's azimuth coverage for 4 seconds (240 azimuth rotation). At the end of that time, the target reappears in the coverage sector for 2 seconds (120° azimuth rotation) during which a maximum of 3 further track looks can be made at equal time intervals of just slightly less than 1 second, a typical preferred rate for track initiation. The total of five looks so obtained may well be sufficient in most case to establish a firm track, yet the entire process is accomplished in only 7 seconds. FIG. 3 illustrates the process pictorially. A similar antenna not using wide angle azimuth phase scan but with the same rotation rate would require 24 seconds to accomplish the same number of track initiate looks, indicating the substantial benefits obtained from the phase scan capability in the rotational mode.

In the stationary operating mode the radar's coverage volume is much lower than in the rotational mode, typically by a factor of three or more. The time/energy management problem for the search function is therefore usually less severe. However, the use of multiple simultaneous beams is still a beneficial capability in order to optimize the division of radar time between the search and track functions to meet desired search and track update rates and track generation times. Additionally, using the phase/phase scan capability, the stationary array has full flexibility to schedule these updates at any time spacing that may be appropriate to optimize overall performance. The present surveillance radar apparatus in no way diminishes update rate flexibility or otherwise restricts operation in the stationary mode, except that as already noted the antenna frequency scan characteristics effectively preclude the use of intra-pulse frequency diversity. However, as discussed previously for the rotational mode, time sequential (pulse-to-pulse or burst-to-burst) frequency diversity is totally compatible with the new architecture, and is actually preferable from a performance viewpoint in track. In search, multiple simultaneous beams are generally needed to accomplish time sequential frequency diversity, but this can typically be accomplished with no increase in hardware complexity.

While the antenna configuration shown in FIG. 2, and discussed extensively above, is believed to be the most useful form of the present radar apparatus it is not the only possible one. For example, instead of using frequency scan in the azimuth plane to supplement the phase/phase scan, it could alternatively be applied in the elevation plane. This would be accomplished by using vertical end-fed manifolds in the elevation plan in place of the corporate elevation feeds shown in FIG. 2, and by use of a corporate azimuth feed. It would provide the capability, for example, of forming multiple beams in an elevation fan formation. However, this is considered to be generally less useful than multiple beams in an azimuth fan, because waveform and doppler processing requirements tend to vary substantially between different elevation beams, but not between different azimuth beams at the same elevation.

It should be noted that the elevation frequency scan capability that could be produced in this way does not suffer the usual disadvantage commonly associated with elevation frequency scan radars. It should also be noted that there is a fixed relationship between elevation angle and frequency, because by appropriate settings of the phase shifters, any desired frequency can be used at any elevation angle.

Finally, it would also be possible to have simultaneous frequency scan capability in both the azimuth and elevation planes, in addition to the full phase/phase scan capability, by using end fed manifolds for both the elevation and azimuth feeds. However, at present, no compelling advantages are seen for this configuration.

Although the invention has been described with reference to a particular embodiment, it will be understood to those skilled in the art that the invention is capable of a variety of alternative embodiments within the spirit and scope of the appended claims.

What is claimed is:

1. A phase/phase/frequency-scan radar apparatus comprising in combination:

a plurality of elevation manifolds receiving an rf signal each of said plurality of elevation manifolds respectively coupled to a plurality of phase shifters thereto, each of said phase shifters operatively connected respectively to a radiating element, said rf signal being applied through said phase shifter to said radiating element, each of said phase shifters being respectively adjusted to affect said rf signal to provide beam steering in elevation, a plurality of azimuth manifolds receiving an rf signal each of said plurality of azimuth manifolds respectively coupled to a plurality of phase shifters thereto, each of said phase shifters operatively connected respectively to a radiating element, said rf signal being applied through said phase shifter to said radiating element, each of said phase shifters being respectively adjusted to affect said rf signal to provide beam steering in azimuth, and means for frequency scanning in azimuth, said azimuth frequency scanning means receiving a plurality of frequency signals to form a plurality of simultaneous beams in azimuth, said plurality of simultaneous beams forming a fan of transmit beams in azimuth.

2. A phase/phase/frequency-scan radar apparatus as described in claim 1 wherein said plurality of elevation and azimuth manifolds and said azimuth frequency scanning means comprise an antenna array.

3. A phase/phase/frequency-scan radar apparatus as described in claim 2 wherein said antenna array is operated in a rotational mode.

4. A phase/phase/frequency-scan radar apparatus as described in claim 2 wherein said antenna array is operated in a stationary mode.

5. A phase/phase/frequency-scan radar apparatus as described in claim 3 wherein said antenna array provides the search function at the antenna rotation rate.

6. A phase/phase/frequency-scan radar apparatus as described in claim 3 wherein said antenna array provides the search function operated at a submultiple rotation rate.

7. A phase/phase/frequency-scan radar apparatus as described in claim 3 wherein said antenna array is operated in the track function and is updated at the rotation rate.

* * * * *